United States Patent [19]

Chen

[11] 4,238,054

[45] Dec. 9, 1980

[54] AIR PRESSURIZED INSULATED CONTAINER

[76] Inventor: Rong-Sheng Chen, 26-2, Lane 233, Fu-Chiang Rd., Tainan, Taiwan

[21] Appl. No.: 3,649

[22] Filed: Jan. 15, 1979

[51] Int. Cl.[3] ..... B67D 5/42; B67D 5/54

[52] U.S. Cl. ..... 222/131; 222/136; 222/209; 222/402

[58] Field of Search ..... 222/131, 136, 209, 211, 222/333, 373, 383, 400.8, 401, 402

[56] References Cited

U.S. PATENT DOCUMENTS

| | | | |
|---|---|---|---|
| 1,964,362 | 6/1934 | Nassif | 222/136 |
| 3,905,520 | 9/1975 | Nishioka | 222/209 |
| 4,113,147 | 9/1978 | Frazier et al. | 222/401 X |
| 4,116,366 | 9/1978 | Takenakashima et al. | 222/401 X |

*Primary Examiner*—F. J. Bartuska

[57] ABSTRACT

An air pressure type compound insulated container capable of providing cold and hot water or different kinds of beverages is disclosed. The container comprises a cover assembly, a cover seat, a discharging pipe assembly, insulated flasks, and a bottle casing. The cover assembly comprises a cover, a twisting member, an air pump, a control member and a fixing plate wherein the twisting member, the air pump and the control member are situated between the cover and the fixing plate. By the operation of the twisting member which drives the control member and exerts force to the air pump for introducing compressed air into a flask, any beverage contained in the flask flows out through an outlet pipe. A projecting lug is provided to control the twisting member so as to maintain the container in closed position.

4 Claims, 9 Drawing Figures

AIR PRESSURIZED INSULATED CONTAINER

BACKGROUND OF THE INVENTION

This invention relates to an air pressure type compound container for introducing compressed air into one of two insulated flasks by means of the cover assembly to discharge two different drinks such as cold or hot water or another beverage contained in the flask, and a projecting lug is provided for controlling the twisting member to maintain the container in closed position.

The conventional vacuum bottle has only one vacuum flask, with a silicone plug to plug the outlet and a cover to cover the outlet. This means has some handling inconveniences such as removing the cover and the silicone plug and slanting the bottle. Another problem with the conventional insulated bottle is that the beverage flowing out is either too hot or too cold to satisfy the needs of users. Even though available in the present market are several improved air pressure type insulated bottles having a cover, an air pump, an outlet tube of beverage for providing beverage, they are incapable of providing hot or cold water or different kinds of beverages from the same container.

SUMMARY OF THE INVENTION

In view of the foregoing, one important object of the present invention is to provide a container having insulated flasks with a cover assembly for introducing hot or cold water or beverage contained wherein by the control of the cover assembly. Another object of the present invention is to provide a cover assembly comprizing a cover, a twisting member, an air pump, a control member and a fixing plate for operating the twisting member to drive the control member and exert force to the air pump so as to introduce compressed air into one of the flasks to discharge hot or cold water or beverages. A projecting lug is provided to control the twisting member to maintain the container in closed position.

Other and further objects, features and advantages of the invention will become apparent from the following description with reference to the drawings annexed hereto.

DETAILED DESCRIPTION OF THE INVENTION

Figure 1:
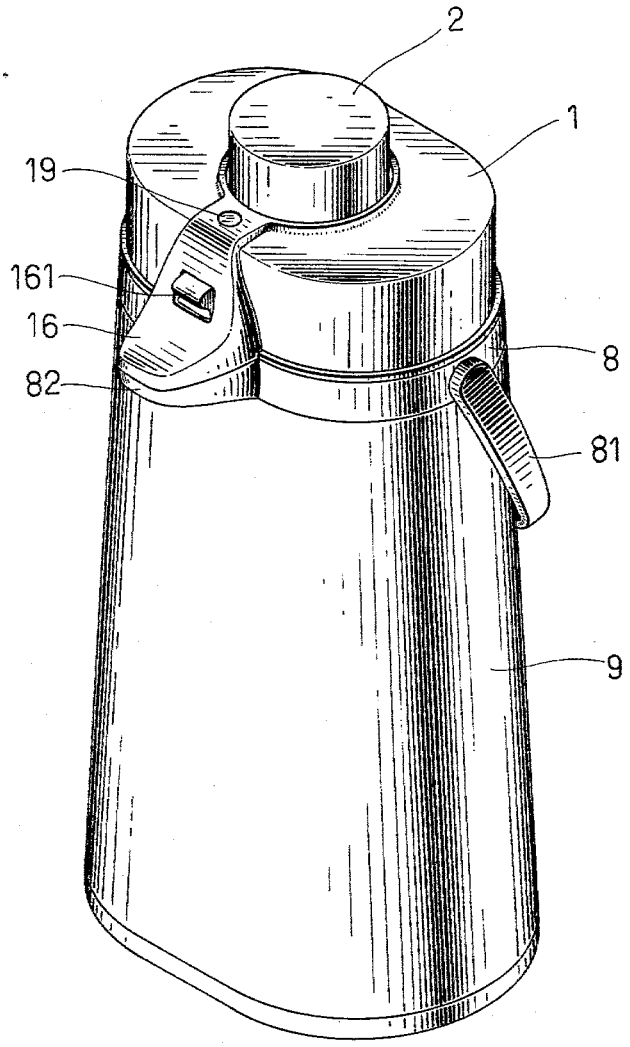
FIG. 1 is a perspective view of an air pressure type compound insulated container in accordance with the invention.
Figure 2:
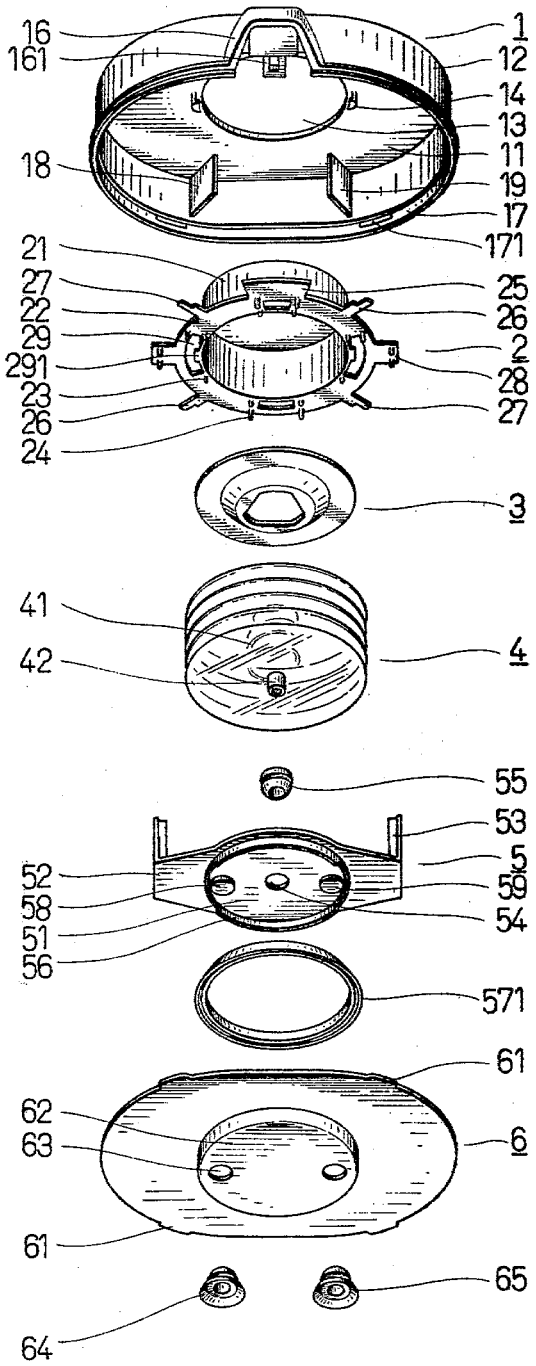
FIG. 2 is an exploded view of the cover assembly in accordance with the invention.

FIG. 2 is a detailed cross sectional and broken view of a cover assembly in accordance with the invention comprizing an elliptically shaped end wall 11 and an annular wall 12. A circular hole 13 is provided in the center of end wall 11. Two projecting lugs 14 in the form of upside-down "L" are provided along the periphery of the circular hole 13 and in the long axial direction of the end wall. An upper duck bill piece 16 is provided in the short axial direction of the annular wall 12. The duck bill piece has a control button 161 to open and close the cover assembly. A viewing hole, as shown in FIG. 1, is formed on the end wall 11 of cover 1. The end of periphery of the annular wall 12 is in the form of a concave annulet 17 wherein symmetrically located four concave slots 171 are provided and a triangular piece is provided, respectively, on the concave annulet situated along the opening end of the concave slot 171. Fixing plates 18 and 19 perpendicular to the end wall 11 are provided on the inside surface of the cover 1.

Figure 3:
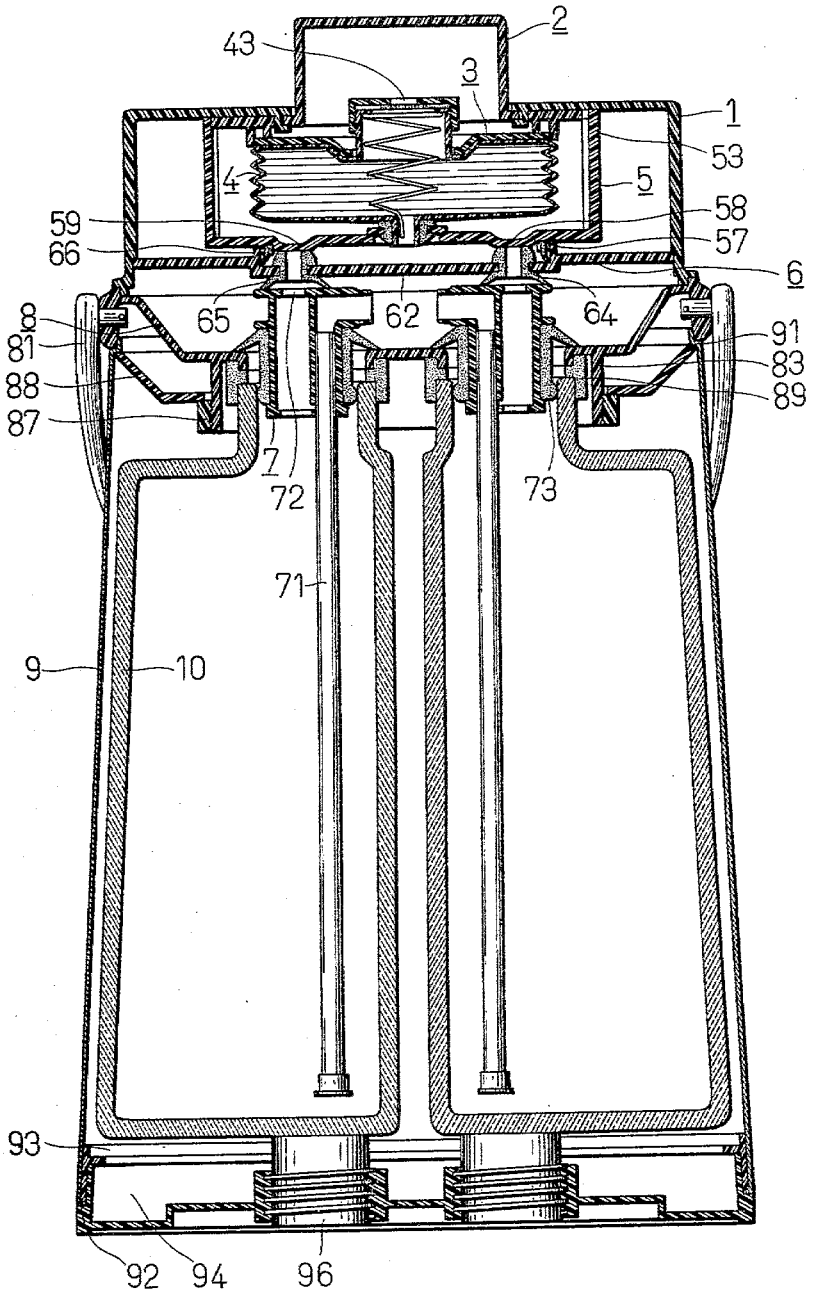
FIG. 3 is a cross-sectional view of the invention.

The twisting plunger 2 comprizes a hollow annular top 21 and a projecting annulet 22. Eight pieces of shorter projecting pins 23 are situated on the inside periphery of projecting annulet 22 and eight pieces of longer projecting pins 24 are situated in the outside periphery of projecting annulet 22. Plate 3 is placed on the projecting pins 23 and secured by the projecting pins 24. The plate 3 is placed in such a manner that by the aid of projecting pins 23 there is a sufficient gap between projecting annulet 22 and plate 3 for permitting air to enter air pump 4 through hollow annular top 21. At the same time, for purpose of avoiding the plate 3 from touching the projecting lug 14, projecting lugs 25, 26, 27 and 28 are provided on the periphery of the projecting annulet 22. Three kinds of symbols, "H", "OFF", and "C", are marked on the projecting lug 25. The projecting lugs 26 and 27 abut respectively to the fixing plates 18 and 19 when they are in different position. Arcuate openings 29 are formed in the projecting annulet 22, each one of them being opposite to the projecting lugs 28. The projecting lug 291 is situated in the center of inside of arcuate opening 29, and is so designed that the opening of the arcuate opening 29 on both sides of projecting lugs 291 is just sufficient enough for permitting the projecting lug 14 on the cover 1 to pass through. The projecting lug 291 is free to slide within the slot formed between the projecting lug 14 and the end wall 13. A spring 41 is provided in the air pump 4 for restoring to its original position after air is discharged through tubule 42. Air moves through the inlet 43 (as shown in FIG. 3) where a flexible check member is provided for controlling air flow. The control member 5 comprizes a circular plate 51 and two projecting lugs 52 having a pair of projecting tabs 53 each of which is provided with slot 531 (as shown in FIG. 5*b*) The slot 531 of projecting tab 53 is used for securing the projecting lug 28 of twisting member 2 to control the revolution of control member 5. There is a bore 54 in the center of circular plate 51. A seal 55 made of silicon butylene rubber passes through the bore 54 and is securely held with its concave ring slot abutting on the convex ring of the annular bore 54. On the opposite side from projecting tabs 53 in the circular plate 51 are two projecting annular tabs 56 and 57 situated side by side, by which a ring shaped packing 571 made of silicon butylene rubber is securely held. Projecting cylinders 58 and 59 are provided along the inside periphery of projecting annular 56 and the two projecting cylinders form an angle of about 155° as shown in FIG. 5. The fixing plate 6 is in an elliptical form having the same dimensions as the concave annulet 17 of the annular wall of cover 1 and has four symmetrically formed triangular projecting lugs 61 along its periphery. When the fixing plate 6 is securely held in the concave annulet 17, the projecting lugs 61 are also held securely in the concave slots 171. A circular tab 62 in the center of fixing plate 6 has two bores 63 in which two umbrella shaped seals 64 and 65 made of silicon butylene rubber are plugged and held securely by means of the concave ring slots abutting against the fixing plate 6. The central portion of the other side of fixing plate 6 is in the form of a concave chamber having along its periphery a projecting annular tab 66 (as shown in FIG. 3) secured to the outer periphery of projecting annular tab 57 of control member 5 thereby forming an inner space. As shown in FIG. 3, discharge outlet pipe assembly 7 is constructed in such a manner that pressurized air is led into flask 10 and then led through an air outlet 72 for permitting beverage to discharge through outlet pipe 71. A cover seat 8 having a handle 81 has a concave handle and is provided with two circular holes for permitting discharge pipe assembly to pass through. The cover seat assembly 8 has a lower projecting duck bill piece on its side in a short axial direction (as shown in FIG. 1). A threaded projecting annular tab 83 is formed at the bottom of the cover seat and each of inner projecting annulets 91 and 92 is situated respectively, on the upper and lower ends of the casing 9. The bottom body 94 is provided with two sets of locked connecting pipes 96.

Refer to FIGS. 2 and 3 for the assembly of the invention. With the projecting lug 25 on twisting plunger 2 with the upper duck bill piece 16 of cover 1, the projecting lug 27 contacts the stopping plate 19 (as shown in FIG. 4*b*), or the projecting lug 26 contacts the stopping plate 18 (as shown in FIG. 4*c*). The hollow annular top 21 pierces through the circular hole 13 and the projecting lug 14 pierces through the arcuate opening 29 thereby permitting the projecting annulet 22 to abutt against the end wall 11. When the twisting plunger is actuated, the projecting lug 291 slips within the slot formed between projecting lug 14 and end wall 11 and because the projecting lugs 26 and 27 are held between stopping plates 18 and 19, the twisting member can only turn within an appropriate angle. When the projecting lug 291 rests within the slot of projecting lug 14, the twisting member 2 is not to move in the axial direction and thus no force is exerted on the air pump 4. With the plate 3 held between the projecting pins 23 and 24, and with the ring shaped packing 571 secured between the projecting annular tabs 56 and 57 of control member 5, and with the projecting annular tab 57 held securely in the projecting annular tab 66 of fixing plate 6, the space formed between control member 5 and fixing plate 6 is made air-tight with the ring shaped packing 571. The tubule 42 of air pump 4 is plugged into the seal 55 of control member 5. And the air pump 4, control member 5 and bottom fixing plate 6 are assembled together and the inlet of air pump 4 abutts to the plate 3. When a force is exerted on the cover 1 and the fixing plate 6, the projecting lug becomes held in the slot 531 of projecting tab 53, and at the same time the projecting lug 61 of fixing plate 6 is held in the concave slot 171 of the annular wall 12 thereby forming a cover assembly. Inner projecting annulet 91 situated at the upper end of casing 9 placed between the cover seat 8 and elliptically shaped spacer 88, and fastened to the projecting annular tab 83 with the threaded annular tab 87. A flexible annular packing 89 is provided between the end of outlet of flask 10 and the cover seat 8, and the flask is supported by the locked connecting pipes 96 provided on the bottom body 94. The bottom body bodies 93 and 94 are situated respectively on each side of projecting annulet 92 and secured to the casing 9. The space between thermos flask 10 and casing 9 is filled with additional insulation to achieve a temperature keeping effect. The discharging pipe assembly 7 pierces through the annular hole of cover seat 8 and the outlet pipes 71 extend deep into flasks 10, and air tightness is maintained between discharge pipe assembly 7 and cover seat 8 by means of packings 73. Cover 1 and cover seat 8 are pivoted by means of a pin. When the cover is closed, the air inlet 72 of discharging pipe assembly 7 is closed by umbrella shaped seals 64 and 65, and securely held by control button 161.

Figure 4A:
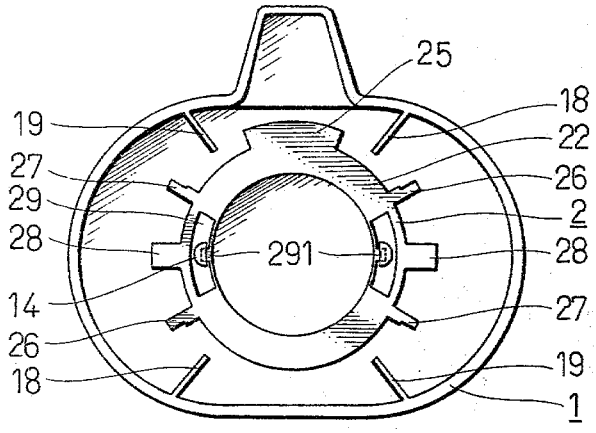
FIG. 4*a* is a top view of the cover assembly with the control button in closed position depicting the operation related to the cover and the twisting member.
Figure 4B:
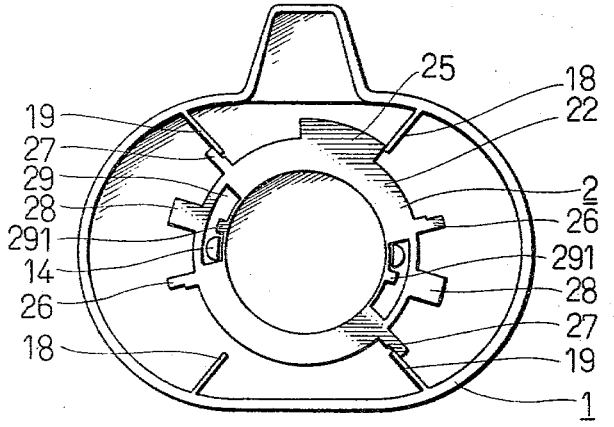
FIG. 4*b* is a top view of the cover assembly with the control button in "C" position for discharging beverage contained in the "C" flask depicting the operation related to the cover and the twisting assembly.
Figure 4C:
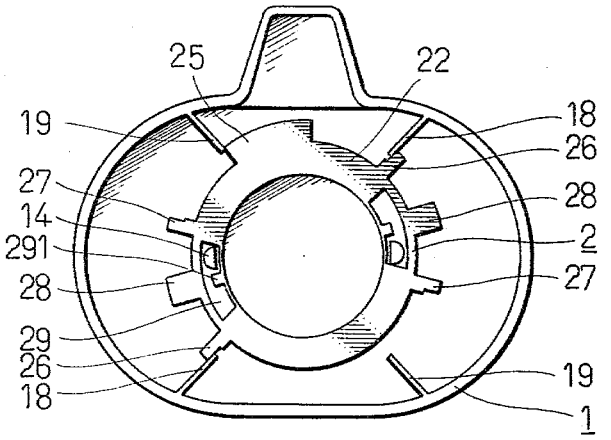
FIG. 4*c* is a top view of the cover assembly with the control button in "H" position for discharging beverage contained in the "H" flask depicting the operation related to the cover and the twisting assembly.
Figure 5A:
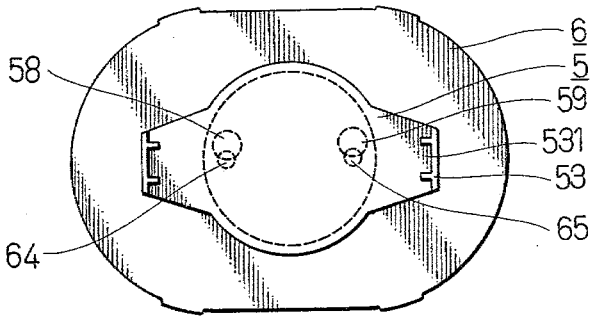
FIG. 5*a* is a top view of the cover assembly with the control switch in closed position depicting the relative position of the control member and the fixing plate.
Figure 5B:
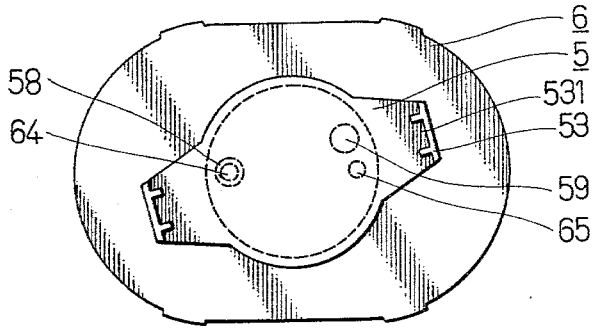
FIG. 5*b* is a top view of the cover assembly with the control button in "C" position for discharging beverage contained in the "C" flask depicting the relative position of the control member and the fixing plate.

Refer to FIGS. 4*a* and 5*a* showing the closed position with a mark "OFF" in view hole. With the projecting lugs 291 resting within the slot formed by the projecting lug 14 and end wall 11, the projecting lugs 26 and 27 do not touch the stopping plates 18 and 19. And the projecting cylinders 58 and 59 do not cover the umbrella shaped seals 64 and 65 of fixing plate 6. In this way, even though a force is exerted on the twisting member 2, the arcuate opening 29 is stuck by the projecting lug 14 thereby producing no axial movement and thus no compressed air is led into the flask to cause the flow of beverage thereby resulting in a closed position.

FIGS. 4*b* and 5*b* show the discharging condition of beverage contained in the "C" flask with a mark "C" in the view hole. The projecting lugs 27 of member 2 abut the stopping plates 19 of cover 1, and each of the projecting lugs 14 rests on one end of each arcuate opening 29, and simultaneously the projecting lugs 28 drive the control member 5 to enable the projecting cylinder 58 to cover the umbrella shaped seal 64 of fixing plate 6. When a force is exerted to make the twisting member 2 move in the axial direction to acutate the air pump 4, compressed air is discharged through the umbrella shaped seal 65 and the air inlet 72 of discharging pipe assembly 7 into the "C" flask thereby causing the discharging of cold water or beverage.

Figure 5C:
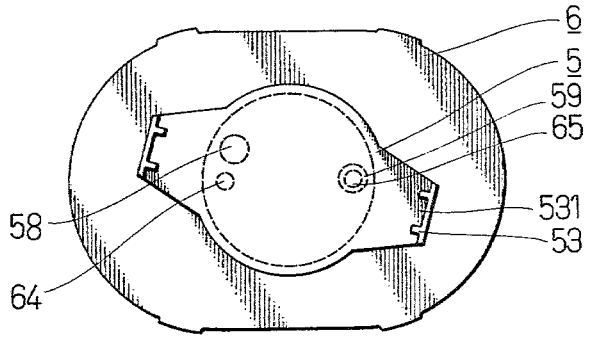
FIG. 5*c* is a top view of the cover assembly with the control button in "H" position for discharging beverage contained in the "H" flask depicting the relative position of the control member and the fixing plate.

FIGS. 4*c* and 5*c* show the discharging condition of beverage in the "H" flask with a mark "H" in the view hole. The projecting lugs 26 of the twisting 2 abut the stopping plates 18 of the cover, and each of the projecting lugs 14 rests on another end of each arcuate opening 29, and simultaneously the projecting lug 28 drives the control member 5 to enable the projecting cylinder 59 to cover the umbrella shaped seal 65 of fixing plate 6. When a force is exerted to make the twisting member 2 move in the axial direction to actuate the air pump 4, compressed air is discharged through the umbrella shaped seal 64 and the air inlet 72 of discharging pipe assembly 7 into the "H" flask thereby causing the discharge of hot water or beverage.

The described invention provides an embodiment of an air pressure type compound insulated container having a new construction, and easy and accurate operation.

What is claimed is:

1. An air pressurized insulated container comprising:

a container casing;

at least two insulated flasks within said casing;

a cover seat assembly secured to the top of said casing and retaining said insulated flasks, said cover seat having spout means and providing openings into said flasks;

a discharge pipe assembly insertable through said openings in said cover seat assembly and having one discharge pipe and one air passage into each of said flasks, said assembly including seal means for pressurizing said flasks; and a cover assembly having latch means for securing said cover assembly to said cover seat assembly, said cover assembly further comprising:

a cover having a central hole therethrough, said cover having lugs projecting into said cover assembly parallel to the axis of said hole and having internal stopping plates parallel to the axis of said hole;

a twisting plunger, operating within said central hole of the cover, said plunger having radially-extending lugs engaging said stopping plates whereby the rotation of said plunger is limited, said plunger having engagement means for engaging said internal lugs of said cover, whereby the axial movement of said plunger is guided and controlled;

a bottom fixing plate, said plate having holes which align with said air passages in said discharge pipe assembly when said cover assembly is latched to said cover seat assembly, said plate containing resilient annular seals extending through each of said aligned holes in the plate;

a control member having a rotating annular seal against said bottom plate and a hole within the annulus of said seal, said control member having sliding engagement means engaging with said twisting plunger whereby said control member and said twisting plunger may be rotated together, said control means having closure means within said annular seal for selectively obstructing said resilient annular seals extending through said bottom fixing plate; and an air pump, said pump being operable by axial motion of said twisting plunger, the air discharged from said pump being conducted through said hole in said control member, through said resilient annular seals in the bottom plate, and through said air passages in the discharge pipe assembly into said flasks for discharge of liquid from said flasks, whereby rotation of said control member provides selection of the discharge by selective obstruction of said annular seals.

2. An air pressurized insulated container as claimed in claim 1, wherein said twisting plunger comprises a hollow annular top and a projecting annulet, said projecting annulet having arcuate openings therein, said annulet having projecting lugs formed in the center of the inner surface of said arcuate openings, and said annulet having projecting lugs of different sizes and shapes for driving, abutting, and indicating purposes.

3. An air pressurized insulated container as claimed in claim 1, wherein said control member comprises:

a circular plate, said plate having radially projecting lugs on opposite sides of said circular plate with slotted projecting tabs extending perpendicularly from said lugs, said circular plate having a central annular bore, said plate having two projecting annular tabs on the side opposite said slotted tabs and having two cylindrical projections within the annulus defined by said annular tabs;

a seal piercing said annular bore in said circular plate; and a ring-shaped packing.

4. An air pressurized insulated container as claimed in claim 1, wherein said bottom fixing plate comprises:

a plate member having a central concave chamber, said chamber having a flat bottom, said flat bottom having two bores therein, said plate member having a projecting annular tab surrounding said concave chamber on the side of said plate member opposite said chamber; and two umbrella-shaped seals, said seals having circumferential slots whereby said seals are installed and retained in said bores of said plate member.

* * * * *